US005565641A

United States Patent [19]

Gruenbaum

[11] Patent Number: 5,565,641

[45] Date of Patent: Oct. 15, 1996

[54] RELATIVISTIC ELECTRONIC MUSICAL INSTRUMENT

[76] Inventor: Leon Gruenbaum, 96 St. Mark's Pl. #2, New York, N.Y. 10009

[21] Appl. No.: 218,646

[22] Filed: Mar. 28, 1994

[51] Int. Cl.[6] ..... G10C 3/12; G10H 1/18; G10H 7/00

[52] U.S. Cl. ..... 84/615; 84/645; 84/451

[58] Field of Search ..... 84/600–602, 645, 84/647, 451, 477 R, 478

[56] References Cited

U.S. PATENT DOCUMENTS

| | | | |
|---|---|---|---|
| 4,947,724 | 8/1990 | Hirano et al. | 84/451 X |
| 5,036,745 | 8/1991 | Althof, Jr. | 84/656 |
| 5,088,378 | 2/1992 | DeLaTorre | 84/470 |
| 5,117,727 | 6/1992 | Matsuda | 84/451 X |
| 5,183,398 | 2/1993 | Monte et al. | 84/478 X |
| 5,306,865 | 4/1994 | Dinnan et al. | 84/451 X |

OTHER PUBLICATIONS

"What's MIDI? Musical Instrument Digital Interface", 18 pages, published by Yamaha, date unknown.

Product Description and Specifications for Thunder Midi Controller, available from Buchla & Associates, dated Sep. 1, 1990, 5 pages.

Robert Rich, Product Review of Buchla Thunder, *Electronic Musician,* Aug. 1990, 4 pages.

*Primary Examiner*—Stanley J. Witkowski

*Attorney, Agent, or Firm*—Lowe, Price, LeBlanc & Becker

[57] ABSTRACT

An electronic musical instrument preferably contains a microprocessor-based MIDI controller which receives signals from a standard IBM-compatible computer keyboard as input and processes the signals to reproduce music. A simple but powerful calculation, wherein keypresses indicate diatonic interval changes in pitch value rather than absolute pitch values, converts the signals generated by the sequence of keystrokes into musical tones on an external synthesizer via the MIDI protocol. Relative key signature changes and changes of the base scale (including non-Western scales) are accomplished with the touch of a button or foot pedal. Tone rows can be created and played back, and harmonic configurations ("chords") selected while playing. The keys on the keyboard are initially assigned functions for optimal ergonomic efficiency, but provision is made for the user to custom-design his or her own keyboard layout and scale configurations.

20 Claims, 11 Drawing Sheets

2

16

80

RELATIVISTIC ELECTRONIC MUSICAL INSTRUMENT

BACKGROUND

1. Field of the Invention

The present invention relates to electronic musical instruments and, more particularly, microprocessor-based MIDI-compatible controllers and instruments.

2. Description of the Related Art

Electronic musical instruments (commonly referred to as synthesizers, keyboards or controllers), are known in which sounds are electronically stored as digital data to be reproduced according to the playing of keys by a musician. Such electronic musical instruments usually have a keyboard, with a repeating pattern of twelve standard Western keys in a layout similar to that of a piano keyboard, in which the selection of a key on the keyboard can reproduce a respective note which is the same as that which would be reproduced by a piano. The conventional keyboard layout is usually employed because musicians have been trained to play a piano-style keyboard and can play such an electronic keyboard without having to learn new and different fingering patterns.

Although prevalent, a piano-style keyboard is not the only layout in which keys may be selected to produce respective notes. For example, U.S. Pat. No. 5,088,378 discusses the adaptation of a typewriter keyboard to the reproduction of music.

Furthermore, since traditional physical constraints to musical instrument design do not apply in the electronic domain, it is possible to design a new and abstract system instrument that solves existing fingering problems. In particular, it is not necessary for the fingering system of an electronic musical instrument to be identical to that of the physical instrument whose sounds it is attempting to mimic. For example, U.S. Pat. No. 5,036,745 discusses the use of an electronic keyboard to mimic a woodwind instrument.

Although some electronic musical instruments produce notes by a method which is not modeled directly after an acoustic instrument, or is abstract in some other way, they nevertheless have an absolute correspondence between a selected keypress and the note produced by that keypress (notwithstanding awkward features such as octave keys and key transpose functions). That is, selection of one of the keypresses reproduces a preselected pitch (typically one of the twelve notes of the standard Western equal-tempered scale) unique to that keypress.

There is therefore no natural way to switch easily from one key signature to another and play a melodic sequence learned in the first key signature without re-learning fingering in the new key signature. Similarly, in order to switch easily from one scale to another and play a melodic contour (a sequence of interval relationships) learned in the first scale, one must re-learn the fingering of that contour in the new scale. Additionally, a melodic contour cannot even be performed at a different position within the same scale and key signature without extensive re-learning of fingering. All of these considerations limit the speed, flexibility and ease with which the keyboardist can perform, especially while improvising.

Traditional keyboard designs also limit the number of notes which are available at any one time to the number of keys on the keyboard. As a result, keyboards either have a limited musical range or are excessively bulky and heavy.

Furthermore, other electronic musical instruments do not present a unified and logical system in which changes of harmonic environment (scales and key signatures) can be made without disturbing a natural-sounding, continuous melodic line.

Also, other electronic musical instruments are often not practical to carry to performances or recording sessions as they are in the form of software to be run on any of several popular computers. And although one could program a portable computer such as a "lap-top" with software, many laptops will not accept MIDI cards, and fewer if any will accept secondary keyboards, such as special ergonomic, injury-preventing keyboards that are best in this application.

Finally, many aspects of the traditional black-and-white keyboard layout have been rendered largely obsolete by advances in musical harmony. This is to say that the melodic patterns preferred by many modern improvisers and composers no longer utilize the harmonic rules and constructs popular in the day the pianoforte was invented. This is perhaps even more important to performers partial to non-Western scales, who are not able to perform in and migrate easily amongst a number of microtonal scales due to a lack of instruments equal to the task. And although some modern synthesizers have the ability to reproduce non-Western scales, many do not, and the standard in the MIDI protocol that addresses this issue has yet to be implemented by synthesizer manufacturers.

SUMMARY OF THE INVENTION

The present invention constitutes a substantial improvement in electronic musical instruments and, in particular, an improvement in microprocessor-based keyboards and synthesizer devices in which MIDI data is processed to reproduce music.

It is therefore an object of the present invention to provide an electronic musical instrument which permits a keyboardist to play melodic lines and contours equally easily in every key signature and scale as well as at any position in the scale, without having to re-learn the fingering patterns as would be necessary on traditional keyboard instruments. The present invention solves this problem by providing a system in which the selection of keypresses controls interval changes in pitch within the currently selected scale rather than fixed, absolute pitches. This is to say a system is provided in which a given key is assigned a relative "movement" value of some number of steps such that striking this key results in the sounding of a pitch exactly this number of steps away, within the currently selected scale, from the previously sounding note. As a result, the performer can easily and rapidly play a melody or contour with exactly the same keypress sequence no matter what key signature or scale or at what position in the scale he or she is playing in, and only a single pattern needs be learned.

Another object of the present invention is to provide such an instrument which permits a performer to play a melodic contour equally easily in microtonal scales, which is difficult even with microtonal-capable keyboards or synthesizers with traditional keyboard layouts since each new microtonal scale requires extensive re-learning of fingering. The ease with which the present invention reproduces microtonal scales will in turn encourage the creation of new and interesting music.

It is a further object of the present invention to provide an electronic musical instrument which will save improvisers and performers the practice time needed to pre-learn fingerings in every key signature and scale. Additionally, when playing the instrument, after the initial selection of key signature and scale, the player need focus only on the overall contour and rhythm of the line. This freedom, combined with the ability to immediately switch scales and key signatures, encourages a certain ease and fluidity in the construction of extemporaneous melodic lines.

It is yet a further object of the present invention to provide an electronic musical instrument which provides the features mentioned in this specification in a unified system, such that a performer using the system moves from pitch to pitch in a seamless and logical way, and changes of scale or key signature do not upset this movement.

Yet another object of the invention is to provide an electronic musical instrument in which tone rows can be created and cycled through in any order and in a manner similar to the normal operation of the keyboard.

Still another object of the present invention to provide an electronic musical instrument in which special harmony configurations (chords) can be selected "on the fly."

It is yet a further object of the present invention to provide an electronic musical instrument in which all pitch is relative and a user with relative pitch is as well off as a user with perfect pitch, perhaps even better since a user with perfect pitch will have to identify intervals in the same way as everyone else and can no longer rely on absolute pitch identification.

It is yet a further object of the present invention to provide an electronic musical instrument in which an average user can play a melody much more easily, since most melodies remain in a diatonic scale, and as long as he or she does not transpose (s)he cannot play a wrong note.

It is yet a further object of the present invention to provide an electronic musical instrument which will increase the user's knowledge and familiarity with basic harmony and intervals, and provide a continuous ear-training teaching tool.

It is yet a further object of the present invention to provide an electronic musical instrument which will be an aid for composers by providing an immediate and continuous source of new melodic ideas, many of which are likely never heard before from any instrument.

It is yet a further object of the present invention to provide musicians with an entire system that is easily portable for performances and recording sessions. The device in a preferred embodiment can fit in a one-half rack space (which is the smallest standard industry size).

It is yet a further object of this invention to provide an electronic musical instrument whose layout is optimally ergonomic according to most frequently played keypresses and keypress sequences, and allows the performer to custom-design his or her own layout.

To play the device in a preferred embodiment of the invention, the operator presses keys on a standard computer keyboard. A simple but powerful calculation converts the signals generated by the sequence of keystrokes into musical tones on an external synthesizer via the MIDI protocol. Key signature changes (relative) and changes of the base scale (including microtonal, non-Western scales) are accomplished with the touch of a button or foot pedal. The keys on the keyboard are initially assigned functions for optimal ergonomic efficiency, but provision is made for the user to custom-design his or her own keyboard layout and scale configurations.

BRIEF DESCRIPTION OF THE DRAWINGS

A further understanding of the present invention may be had in connection with the accompanying drawings, in which.

DETAILED DESCRIPTION OF THE PREFERRED EMBODIMENTS

Figure 1:
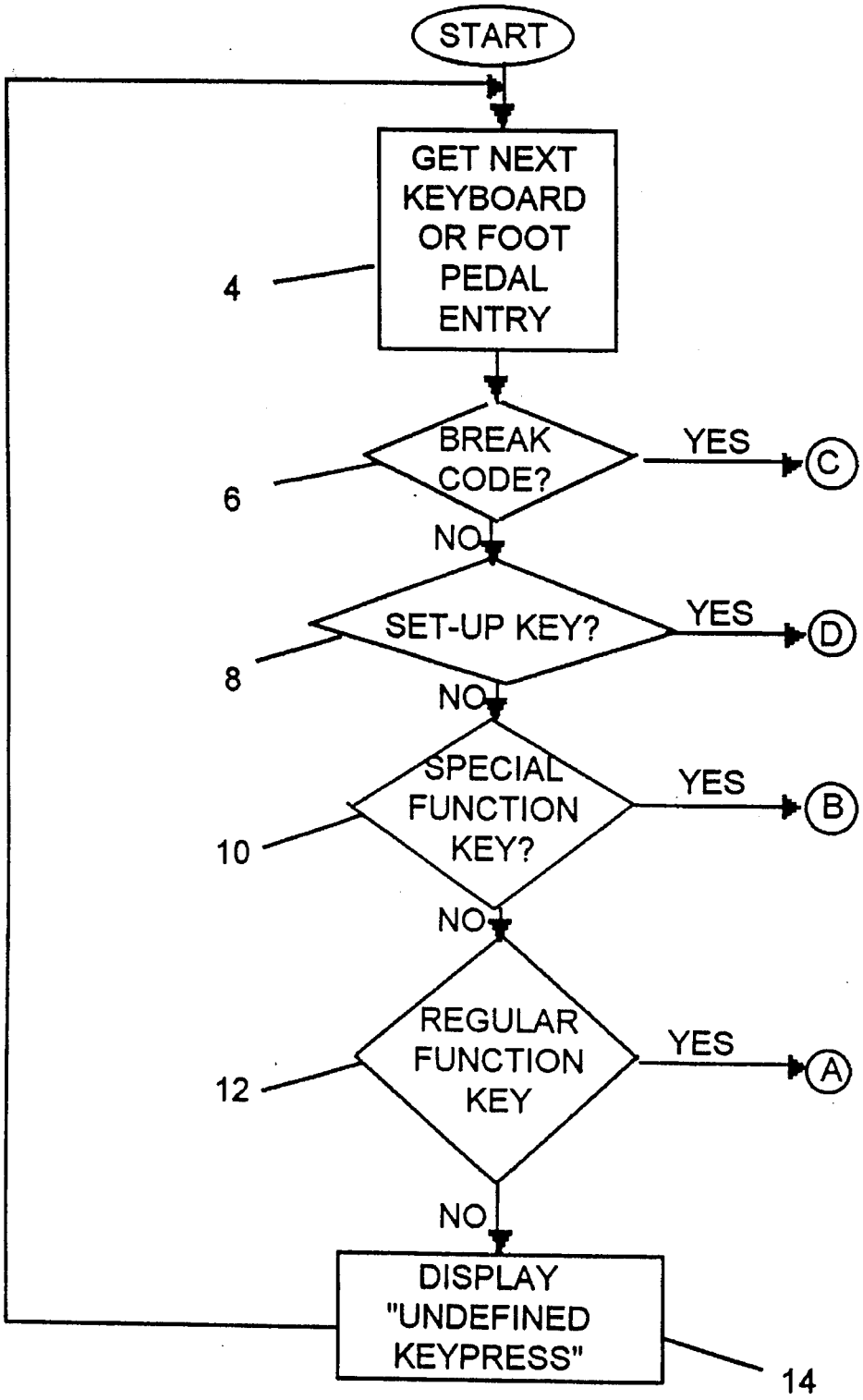
FIG. 1 is a flowchart of the basic process of converting selection of keys on a keyboard into music in an electronic musical instrument according to one embodiment of the invention.

Preferred embodiments of the invention will now be described with respect to FIGS. 1–13 of the drawings in which the following terms and concepts are defined or re-defined as follows.

WESTERN SCALE

The term "Western Scale" refers to any sequence of frequencies using the equal-tempered scale invented by Bach. Western scales have become the standard throughout much of the world.

MICROTONAL SCALE

A microtonal scale is any non-Western scale.

MODULATION

Modulation is the changing of the key signature.

INTERVAL

A musical distance. This term is used strictly in a diatonic sense (see diatonic below).

SCALE AND THEIR REPRESENTATION

A scale is any ordered set of intervals from the root. A Western scale may include up to 12 whole multiples of semitones. But in general, any ordered set of intervals, with resolution of up to 1/64 of a semitone, is considered a scale. This definition means that a scale may be non-Western because of the number and resolution of its semitones or because it is "out of order" and repeats the cycle at a point other than what is generally considered an octave (twice the frequency of the root).

DIATONIC

A diatonic characteristic is one measured in the scale currently selected.

CHROMATIC STEP

A chromatic step is the interval which is defined as chromatic in a given scale's data. Thus a chromatic step in one scale may be different from a chromatic step in another.

OCTAVE

The interval that is added to the current note once all of the notes of a scale have been cycled through. If a scale were to be defined according to modular arithmetic, the octave would be the base. Again, the octave interval is defined in a given scale's data, and the octave of one scale may be different from the octave of another. So the octave of a microtonal scale is not necessarily the interval of the Western scale, in which the top note is twice the frequency of the bottom note.

TONE ROW

An ordered set of unique intervals from the root, with a size no greater than the number of intervals in the underlying scale currently selected.

Using the above definitions, the basic notes of the Western major diatonic scale (which in the key signature of C are commonly referred to as C, D, E, F, G, A, and B) can be represented by the following set of numbers: {0, 2, 4, 5, 7, 9, 11}. However, if we want to develop a numbering system which allows for the possibility of microtonality and extended chromatic octave definition, the notes can be represented by the following pairs of numbers:

{(1,0), 12, (0,0), (2,0), (4,0), (5,0), (7,0), (9,0), (11,0)}, where pair #1 and integer #2 represent the number of semitones in a chromatic step and the number of semitones in an octave, respectively; and the remaining pairs representing each note (interval), the first number of the pair denoting the whole number of the semitone of the note and the second number denoting the number of 1/64's of a semitone of the note.

Similarly, the pentatonic scale would be represented thus:

{(1,0), 5, (0,0), (2,0), (4,0), (7,0), (9,0)},

And the "decimal scale" (10 equal-tempered notes/octave) thus:

{(0,38), 10, (0,0), (1,13), (2,26), (3,38), (4,51), (6,0), (7,64), (8,26), (9,38), (10,51)}

In this document, the examples to follow use the standard Western scales most musicians are familiar with. However, it should be understood that because the invention works identically in microtonal scales, all examples will work microtonally by extension.

Figure 8:
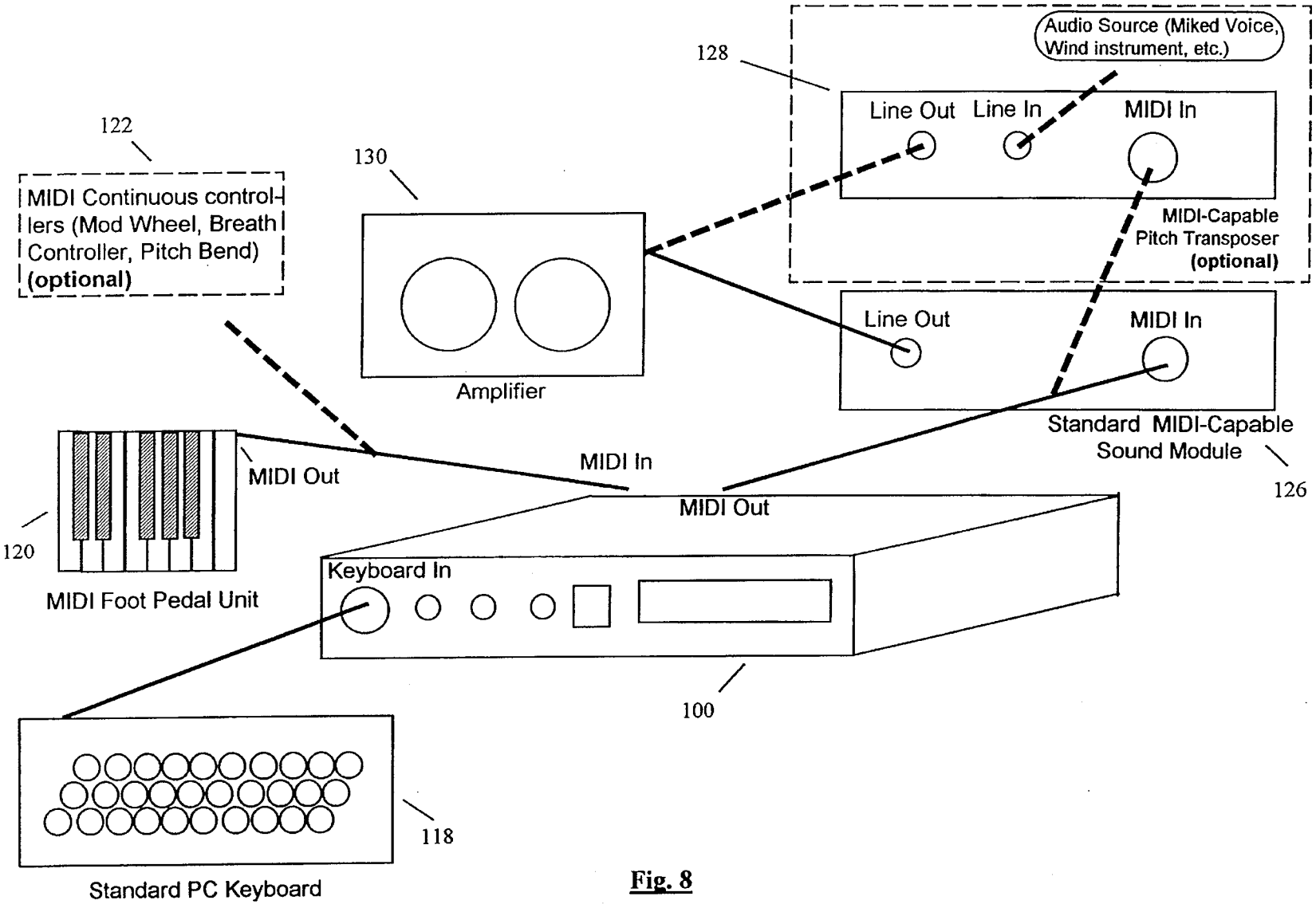
FIG. 8 is a system diagram in which the electronic musical instrument according to a preferred embodiment of the invention is utilized in a total music environment, showing optional connections for the instrument to produce sound.

FIG. 8 shows the application of the electronic musical instrument according to a preferred embodiment of the invention. In this embodiment, the instrument is a microprocessor-based MIDI controller contained in modular unit 100 which outputs MIDI data so that sound can be reproduced by other synthesizers.

The module unit may also be used to control MIDI-fitted acoustic instruments, such as currently available MIDI-capable pianos or future instruments such as a saxophone, where the user would merely blow on the mouthpiece and use the module unit to replace fingering.

The unit is a lightweight, half-space standard rack unit having standard dimensions (for example, 8.5"×10.8"×1.7") enabling it to be mounted in equipment designed for holding audio and other technical equipment. It accepts keyboard input from a standard AT-style IBM-compatible keyboard 118 through a standard 5-pin DIN connector, and MIDI input from a MIDI foot pedal unit 120, as well as other optional MIDI controllers 122 for effects such as pitch bend, mod wheel or breath controller. Modular unit 100 outputs MIDI data to other synthesizers 126 and for driving an amplifier 130 to produce the sound. The environment may also include optional MIDI-capable pitch transposers 128 for using the MIDI data from modular unit 100 to transpose the pitch of other audio sources.

Figure 6:
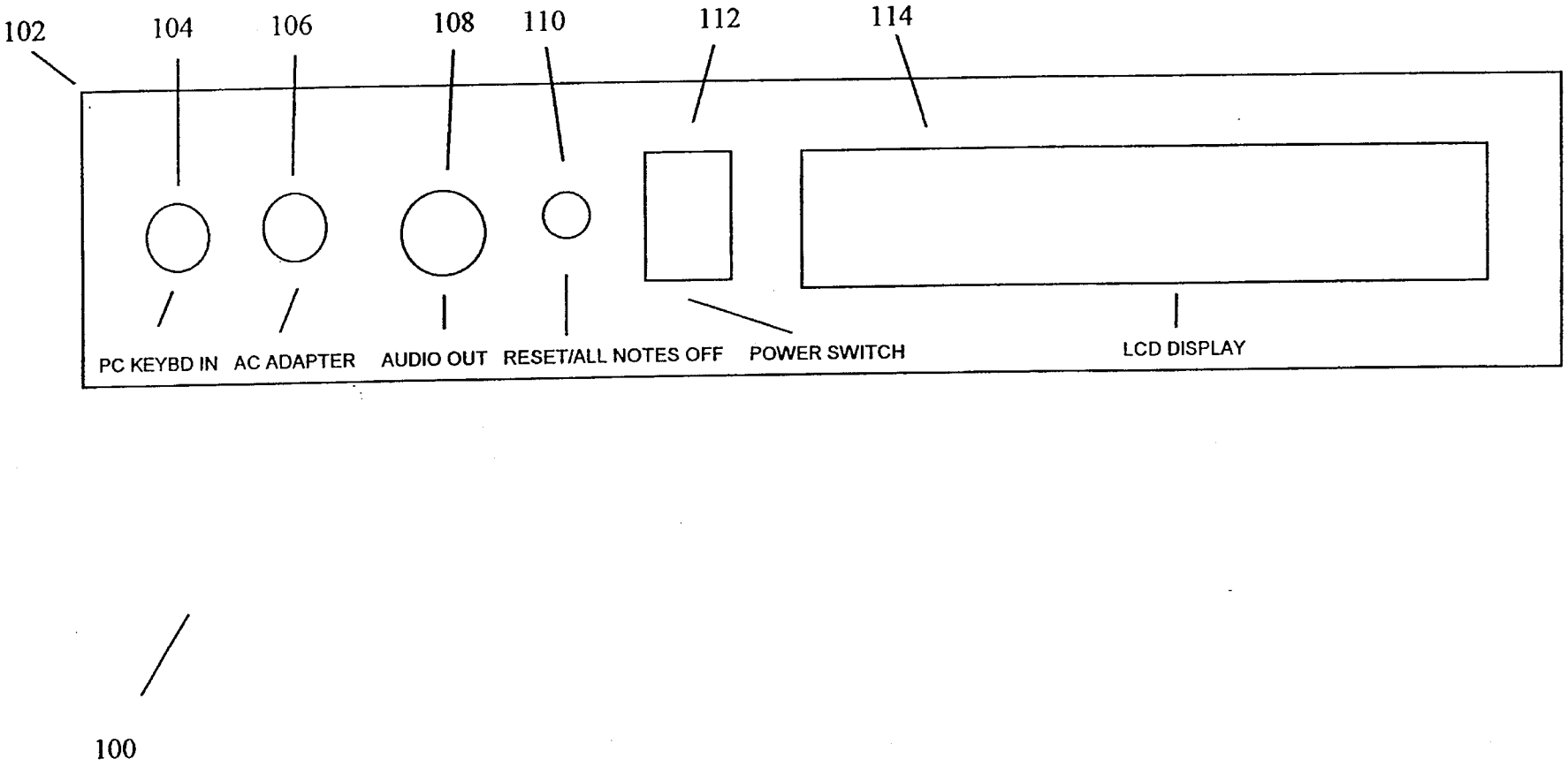
FIG. 6 is a front panel diagram of a rack (industry-standard, 19" width chassis) unit for an electronic musical instrument according to one embodiment of the invention.

The front panel 102 of modular unit 100 is shown in FIG. 6. It has a standard 5-pin DIN connector 104 for receiving signals from keyboard 118, a DC Power Jack 106 for receiving the output of an AC adapter (9–12 V, 800 mA), an audio output terminal 108 for outputting a microprocessor-generated audio signal for use with headphones or as "line level" output, a reset/All-notes-off button 110 (for use in case of "stuck notes"—sends MIDI "Note off" on all channels—or in case keyboard "jams"), a power On/Off switch 112, and a 24×2 character LCD display screen 114.

When the modular unit is in a Setup Mode, display screen 114 displays current values of various parameters and configurations, helps with changing and editing of those parameters and configurations and allows saving of settings to Non-Volatile RAM. When in Play Mode, display screen 114 displays information such as the current scale, key signature, and note value. (The specific information displayed and the display style are determined by the Display Mode currently selected.) Note that as an alternative, the display could be mounted directly on the keyboard so that all relevant information is easily and immediately seen by user.

The modular unit inputs and outputs MIDI data at respective connections (not shown) on the rear of the modular unit as indicated above.

PEDALS

As mentioned, the foot pedal unit 120 is optional since every pedal function can be duplicated on the computer keyboard. The one-octave MIDI pedalboard shown in FIG. 10 may be a conventional pedal unit or an optimal pedalboard having at least twice the number of pedals as that in FIG. 10 to allow changes of both scale and key signature by single footpresses.

The pedals of foot pedal unit 120 can be programmed to substitute for any keypress, but are optimally used for modulation and chromatic shifts because one can continue playing keyboard keys while depressing the pedals. Note that chromatic shift pedals work as they would on the computer keyboard; i.e., they lower or raise the pitch while they are depressed. While the rightmost pedal (Scale select) is depressed, depression of the other pedals select scales S1–S12 as shown as the parenthetical designations.

Alternatively, since MIDI foot pedals are expensive, heavy, require power, and are slow in sending data, one could construct a foot panel of aluminum and heavy-duty pushbutton switches. These buttons would be connected directly to the single-board computer in such a way that when depressed, they would short normally high "IN" port bits to ground. The program would then poll, between checking for incoming keyboard data, to see if any have been depressed. As with the MIDI foot pedal unit, any pedal or button could be programmed to substitute for a keypress.

ERGONOMIC KEYBOARD LAYOUT

Keyboard unit 118 may be a conventional electric typewriter or computer keyboard or any keyboard which emulates a conventional computer keyboard. The "typematic" action of conventional computer keyboards, wherein a key's "make code" repeats many times per second when held down, is suppressed or ignored by the processor, except for keys denoting Vol Up, Vol Dn, Tune Up or Tune Dn, in which cases these functions operate continuously as long the keys are depressed (or their respective parameters remain in the proper range). In addition, other input devices which allow for selections to be made by an operator, such as touch sensitive keyboards or touch screens, may be used as well. The keyboard optimally is configured so that each hand can easily (without moving) access a number of keys larger than that of a piano-style keyboard. Most importantly, the keyboard utilizes user-assignable keys for maximum flexibility.

Figure 7:
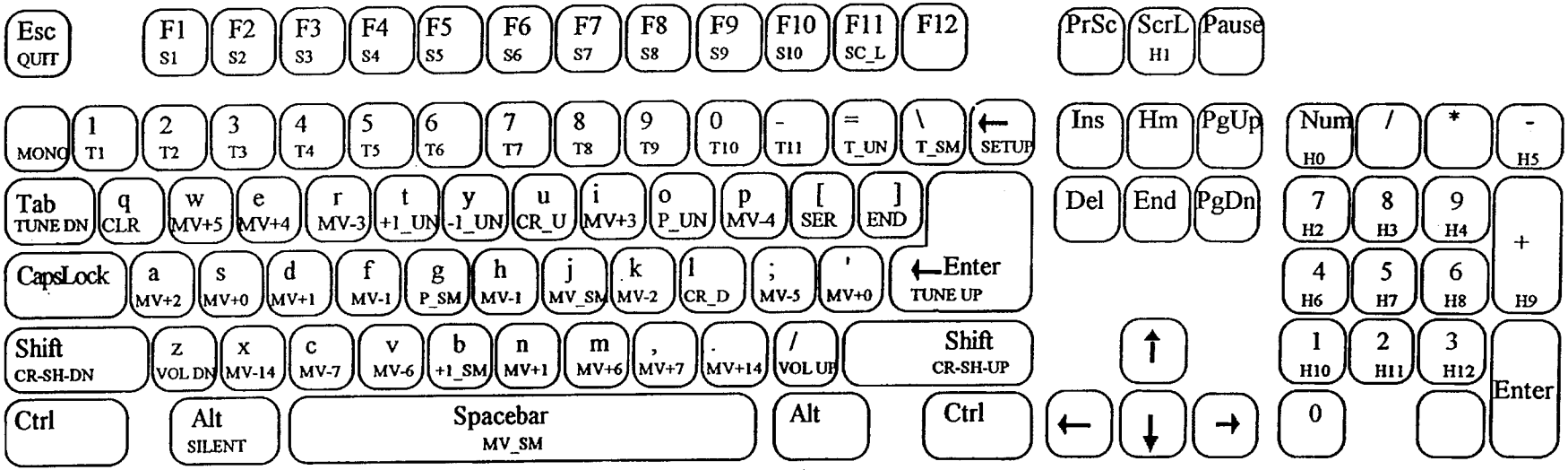
FIG. 7 illustrates the assignment of keys on a keyboard in a preferred embodiment of the invention.

The preferred assignment of the keyboard layout shown in FIG. 7 was determined by an artificial intelligence program written by the inventor. The goal of the program was to design a layout that would facilitate speed and help to prevent injury, a serious problem for keyboardists.

The current layout places the most important keys under strong fingers and in positions such that it is possible to play one's melodic line by the alternating use of hands in a rhythmic movement similar to that found in hand percussion. In cases where alternation of hands is not possible, the program attempts to induce movement for a two-note sequence to two different fingers of the same hand, preferably from the outside of the hand to the inside. With the preferred keyboard assignment it will rarely be required to play two notes in succession with the same finger. Furthermore, the keyboard assignment shown in FIG. 7 duplicates certain important keys such as MV_SM and MV-1 in order to avoid fingering "jams" despite the resulting slight sacrifice in keyboard "real estate."

The system has an option wherein the user's personal optimal keyboard layout is determined on past performance by means of an "artificial intelligence" routine based on which keys and sequences of keys one strikes most often. Another option is a dynamic keyboard layout, in which the system automatically reconfigures your keyboard layout while you are playing, either randomly or based on a preset list of layouts.

Figure 9:
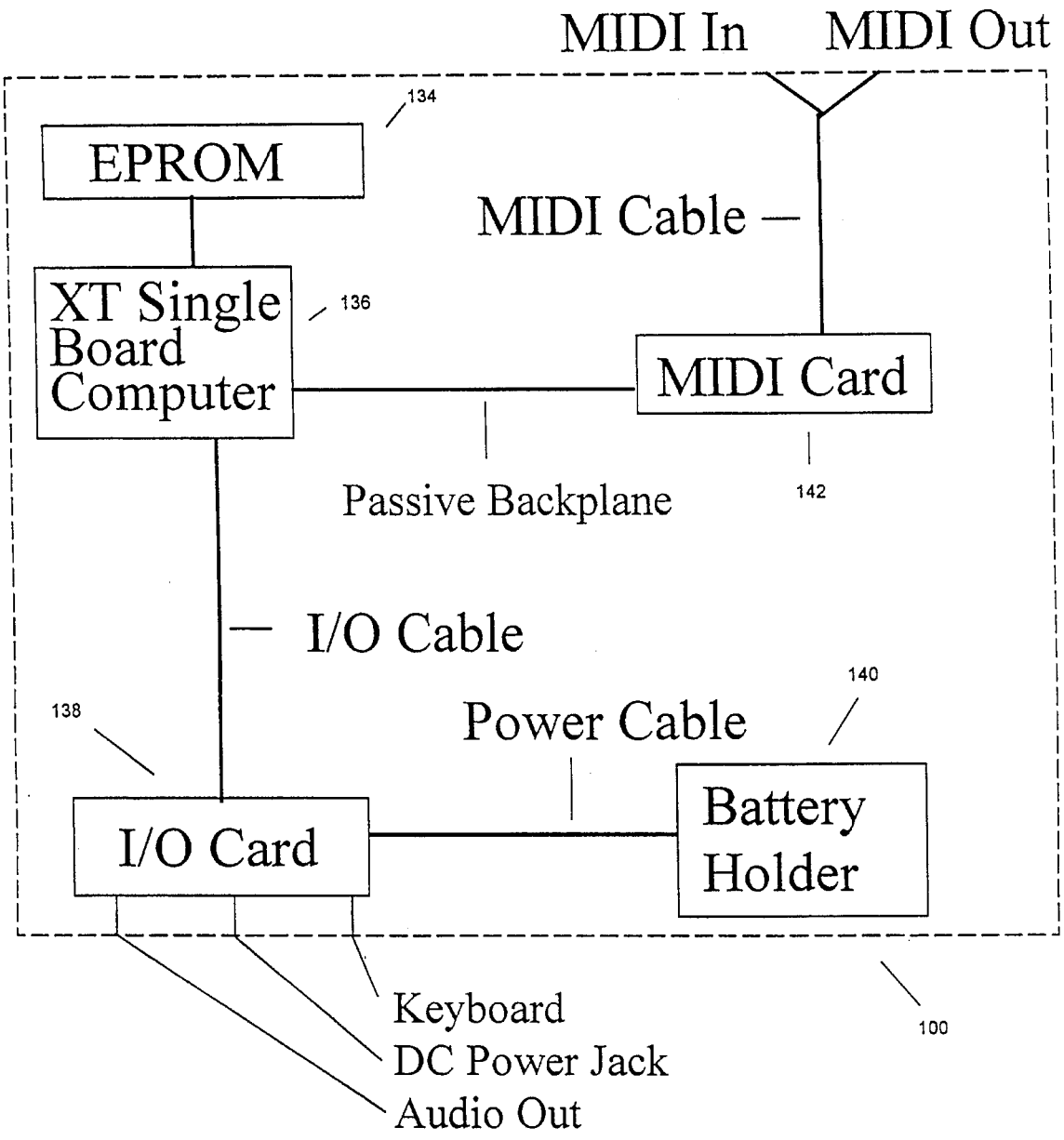
FIG. 9 shows internal components and connections of a rack unit according to a preferred embodiment of the invention.
Figure 10:
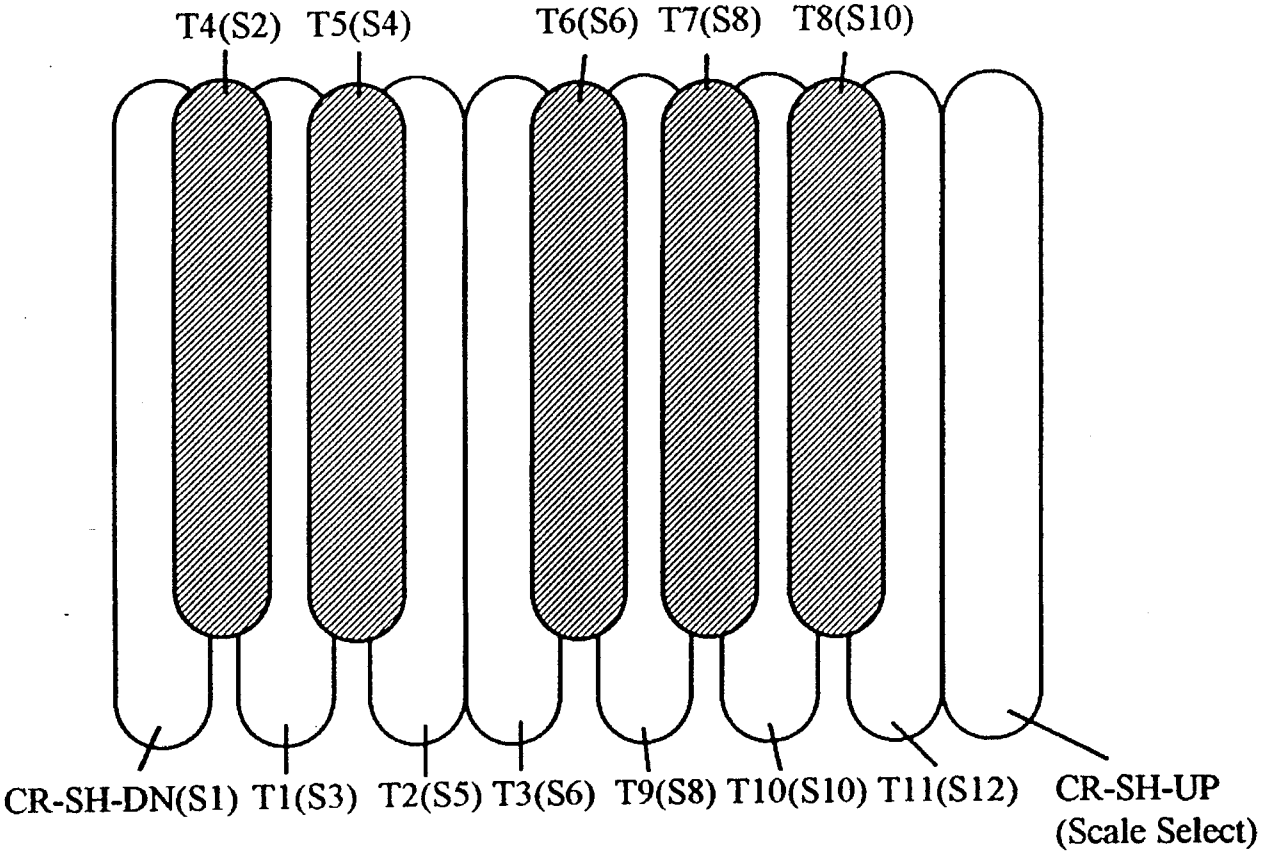
FIG. 10 shows pedal assignments for an optional pedal unit to be used in a preferred embodiment of the invention.

FIG. 9 is a block diagram of the internal components and connections of modular unit 100. I/O Card 138 receives the signals from keyboard 118 through connector 104. The keyboard may be an AT-style IBM-compatible keyboard, or any standard computer keyboard, or a keyboard specially designed for this use. The I/O card receives a DC power supply through power jack 106, and outputs display signals to display screen 114 and an audio signal to audio output 108. This audio output may be a simple square wave oscillation of the microprocessor port, or it may involve a deeper manipulation of the square wave to simulate a more complex oscillator. Modular unit 100 may also operate on an internal 12 volt power supply from batteries in battery holder 140 when power is not supplied to power jack 106.

The signals received by I/O card 138 are forwarded to a single board microprocessor unit 136. The microprocessor unit 136 may be a conventional XT single board computer operating at 5 MHz. An MV-101 MIDI card 142 outputs MIDI data from modular unit 100 and receives MIDI data from optional MIDI Foot Pedal Unit 120 and/or other MIDI controllers 122. The incoming MIDI data is forwarded on a backplane to microprocessor unit 136 to be processed along with the keypress signals from the keyboard in accordance with a program stored in EPROM 134.

Figure 2:
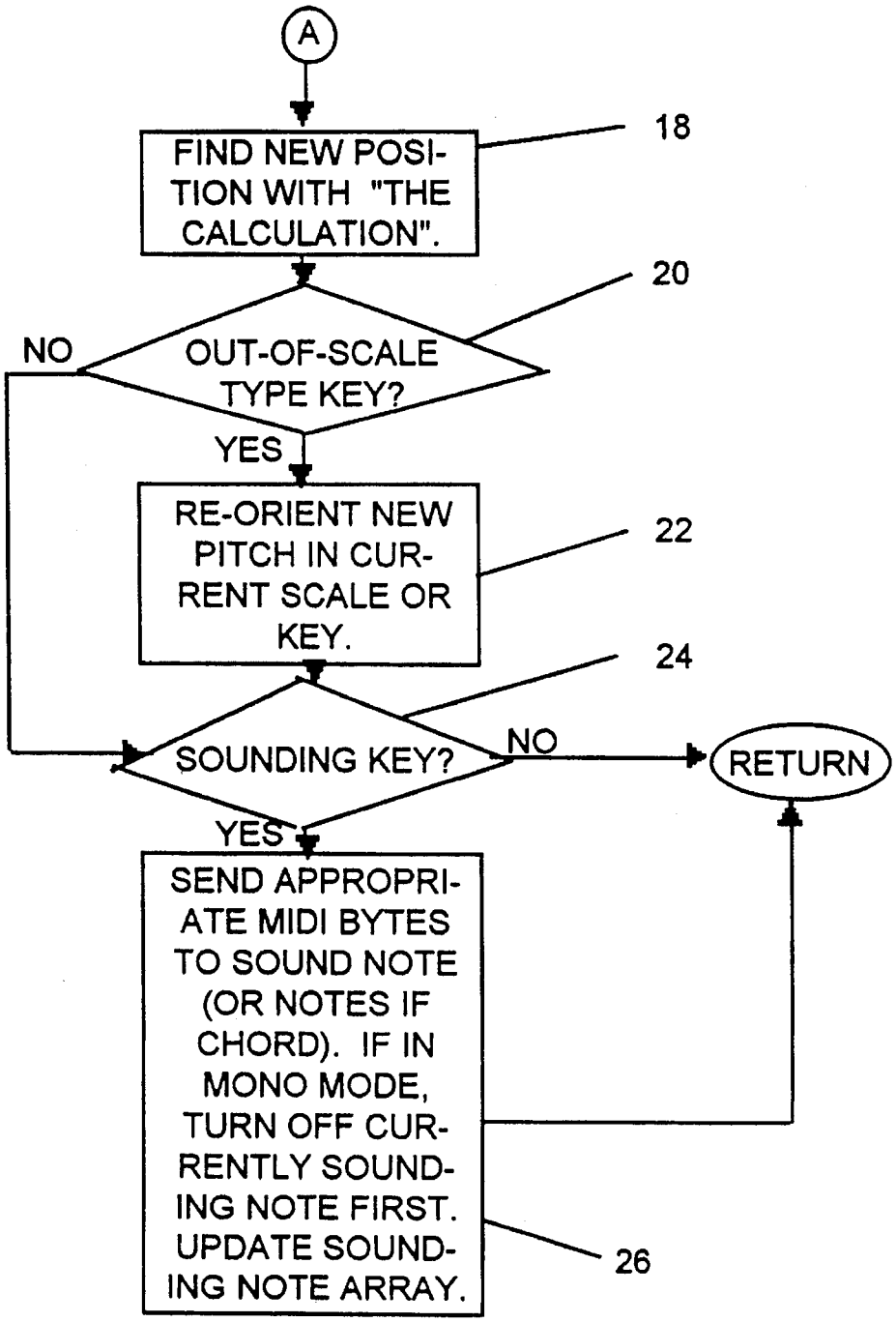
FIG. 2 is a flowchart of the subroutine performed when a key is released (sending a break code) by the operator in an electronic musical instrument according to one embodiment of the invention.
Figure 3:
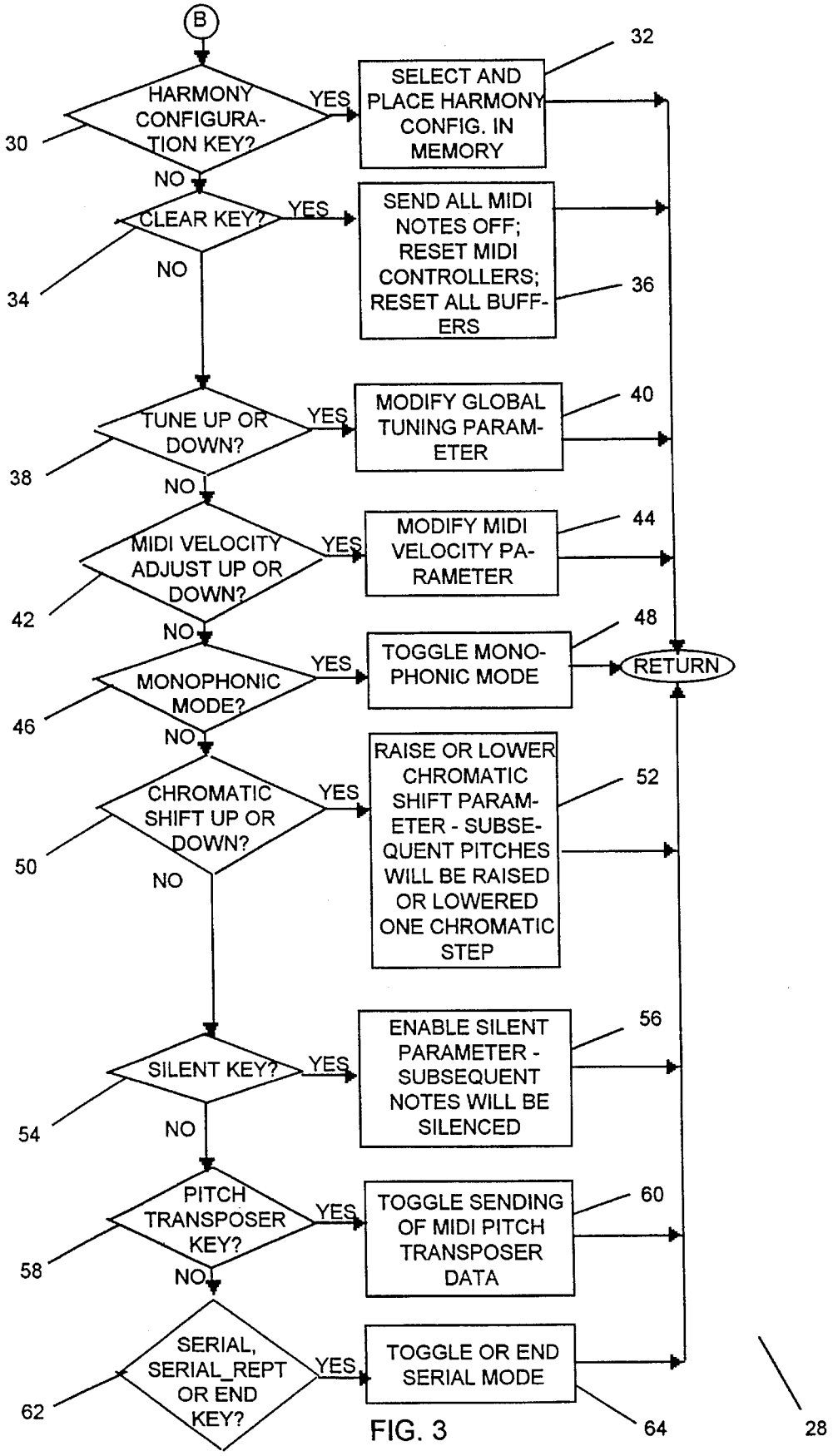
FIG. 3 is a flowchart of the subroutine performed when a set-up key is selected by the operator in an electronic musical instrument according to one embodiment of the invention.
Figure 4:
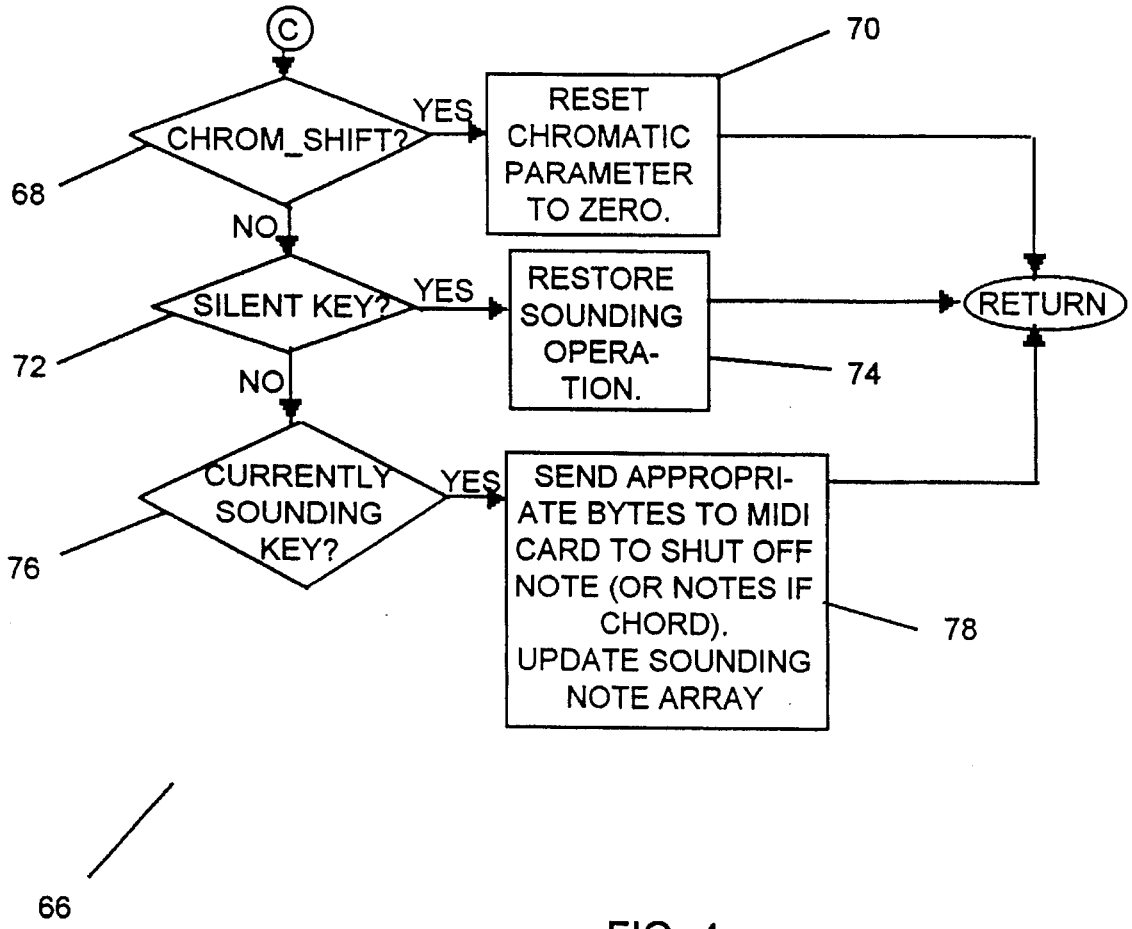
FIG. 4 is a flowchart of the subroutine performed when a special function key is selected by the operator in an electronic musical instrument according to one embodiment of the invention.

The process carried out by the program stored in EPROM 134 is illustrated by the flowcharts in FIGS. 1–5. FIG. 1 shows the start of the instructions to the microprocessor (2). When a key is pressed or released, the keyboard transmits the appropriate scan code as a sequence of electronic pulses, the first of which triggers an interrupt; the remainder, which make up the byte defining the keystroke, are read through the IN port. Step 4 detects when a keyboard entry is received and step 6 determines whether or not it is a "break" code, i.e., a release of a key (as opposed to a "make" code, the depression of a key.) If the incoming signal is a break code, subroutine 66 in FIG. 4 is carried out.

If the incoming signal is not a break code, then it must be a make code and step 8 determines whether it is the SETUP key. If it is, subroutine 80 in FIG. 5, known as the Setup Mode, is carried out as discussed later.

If the incoming signal is not the SETUP key, it is next determined by step 10 whether the incoming keystroke is one of the "Special Function Keys." If it is, subroutine 28 in FIG. 3 is carried out as discussed later.

Finally, it is determined by step 12 whether or not the incoming key is an "Regular Function Key". If it is, subroutine 16 in FIG. 2, is carried out as explained later.

Otherwise, the keypress is not defined and the module unit displays an "Undefined Keypress" message at step 14 and returns to wait for the next keypress.

FIG. 2 shows the subroutine for "Regular Function Keys". Below is a list of the Regular Function Keys:

| | |
|---|---|
| MV+n, MV-n | Move n notes up or down in scale |
| MV_SM | Repeat last move |
| P_UN | Undo last move (returns you to penultimate pitch) |
| $P_UN_n$ | A key similar to P_UN, but plays n notes before, n defined in SETUP MODE. |
| P_SM | Repeat last pitch distance (repeats change in frequency ratio irrespective of current scale) |
| +1_UN | Undo last move plus one |
| −1_UN | Undo last move minus one |
| +1_SM | Repeat last move plus one |
| CR_U, CR_D | Move up or down by one chromatic step ("chromatic" as defined in scale data) |
| $CEN_1$ | Centering key #1 |
| $CEN_2$ | Centering key #2 |
| $CEN_3$ | Centering key #3 |
| $CEN_4$ | Centering key #4 |
| $S_n$ | Select scale #n (user-defined) |
| SC_L | Return to last scale selected |
| $T_n$ | Modulate by amount #n (user-defined) |
| T_UN | Undo last transpose |
| T_SM | Repeat last transpose |

A variety of other functions may be optionally included as well. For example, Temporary Scale Altering Keys may be used, which, when depressed in combination with a move key and possibly a chromatic shift key, temporarily change the current scale until they are pressed again. These keys provide a way of temporarily modifying the current scale in real-time (adding, deleting, or changing a note of the scale).

MOVES

Figure 12:
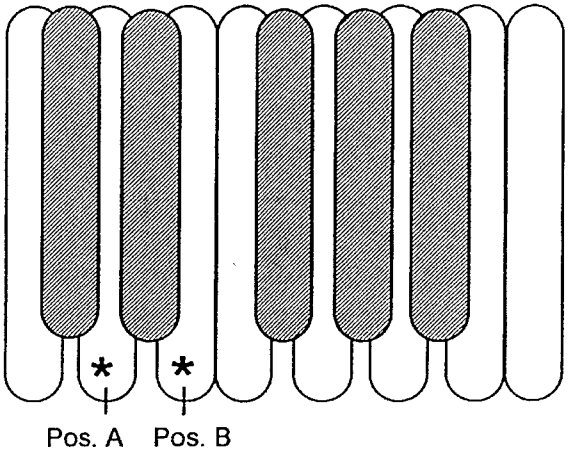
FIG. 12 illustrates a second example of a key move.
Figure 11:
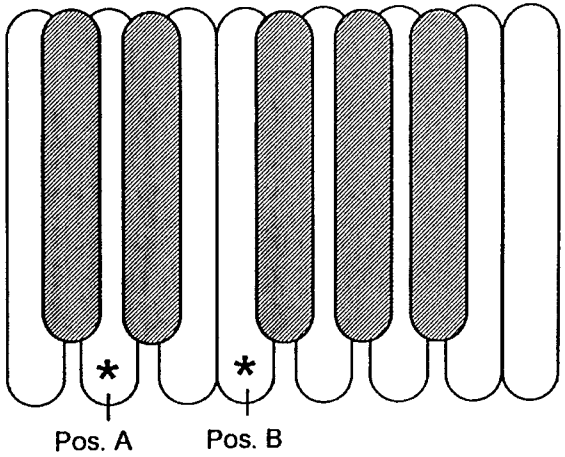
FIG. 11 illustrates a first example of a key move.
Figure 13:
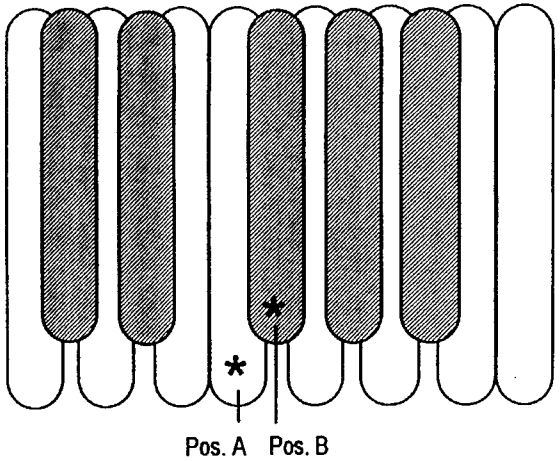
FIG. 13 illustrates a third example of a key move.

The move (MV+n, MV−n) is the central notion to the relative method of this invention. To play a note in this system, one does not press a key denoting a fixed pitch as one does on a traditional keyboard. Instead, one presses a key denoting a interval change in pitch. Examples of moves are illustrated in FIGS. 11 through 13.

FIG. 11: "MOVES": 1ST EXAMPLE

You are in the key signature of 'C' and you are at Position A (Pos. A). This is to say the last note sounded was a 'D'. You would like to hear an 'F' next. You press the MV+2 key, resulting in a move to Pos. B (an 'F'). Note that repeating the same keystroke will not repeat the 'F,' because you will move two more notes up in the scale to an 'A.'

One immediate advantage of this system is the ability to access all 128 notes (almost 11 octaves) of the MIDI specification without a need for octave shift keys. While you can't easily move more than seven notes away in one jump with the preferred keyboard layout (see discussion of the "Silent" key), most melodic lines don't make large jumps anyway, relying instead on stepwise motion or skips of two or three notes at most.

Once the basic principle of an interval move is grasped, one can move on to more sophisticated moves such as MV_SM, in which the pitch is moved an interval distance equal to the last move. Similarly, P_UN undoes the last move, returning the pitch to where it was before the last move. +1_UN moves an interval equal and opposite to the last one, augmented by one. Similarly, −1_UN moves an interval equal and opposite to the last one, diminished by one, and +1_SM moves an interval exactly equal to the last one, augmented by one. P_SM is similar to MV_SM, but repeats the frequency ratio, not the diatonic interval. Therefore, P_SM may well take you out of the scale you are currently in.

The centering keys ($CEN_1$–$CEN_4$) are valuable to users without perfect pitch since position and transposition are completely relative in this system. $CEN_1$ performs a move to the root of current scale in the current octave in the current key signature. $CEN_2$ performs a move to the root of the current scale in the "middle" octave in the current key signature. $CEN_3$ performs a move to the root of the current scale in current octave in the key signature of 'C.' $CEN_4$ performs a move to the root of the current scale in the "middle" octave in the key signature of 'C.'

CR_U and CR_D move one chromatic interval up and down, respectively. A chromatic step is defined by the scale data.

SCALES AND KEYS

A scale ($S_n$) is selected by pressing one of the scale keys. The system automatically reorients itself to accommodate the new set of pitches. A key signature change ($T_n$) is simply the result of a translation of the scale by an amount specified in the scale data.

KEY SIGNATURE AND SCALE CHANGES

Key signature changes are relative as well. If you are in the key signature of F (major scale), and you wish to be in the key signature of C, you must depress the T11 key. If this pedal or key is pressed again, you will find yourself in the key signature of G. In the preferred embodiment, in the equal-tempered diatonic scale data, the modulation keys are arranged in order of increasing "flatness," i.e., the leftmost key will add one flat to the key signature, the second two flats, and so on. (The rightmost, T11, will add 11 flats, or equivalently, 1 sharp.) Pressing a modulation pedal or keyboard key does not make a sound by itself.

Note that if the set of pitches in which you are "operating" changes, either by modulation or change of the scale, or the Function Key places you outside the current scale (20), then the system automatically re-orients itself, so that the next move places you at an appropriate point in the new set of pitches (22).

There are two possibilities when such a change arises: either the current note is a member of the new scale or key signature, or it is not. If it is, the system continues as one would expect. If not, an adjustment needs to be made. The invention may also permit pre-sequenced scale or key signature changes to be triggered by a special key. For example, the change may be triggered by a special key, a fixed note or randomly.

The principle is that if the current note is not in the new set of pitches, a subsequent MV+n_keystroke moves you n notes up_in the scale, counting the first note higher than the current note as "one." (The same principle applies to going down in the scale—substitute "−n" for "+n" "down" for "up" and "lower" for "higher" in previous sentence.) MV+0 will always repeat the last pitch, even if it is not in the current scale.) This adjustment principle applies similarly if the scale changes, and not the key signature.

See examples of these situations below:

FIG. 12: "MOVES": 2ND EXAMPLE

You are in the key signature of 'C' and you are at Pos A (an 'D'). You press T11 to go to key signature of 'G'. You press MV+1. Because the note 'D' exists in the key signature of G, the system moves you to 'E' (Pos. B) (and plays it for you). There is no confusion in this case.

FIG. 13: "MOVES": 3RD EXAMPLE

You are in the key signature of 'C' and you are at Pos A ('F'). You press T11 to go to the key signature of 'G'. You press MV+1. Because there is no 'F' in the key signature of G, the system moves you to the next highest note in the scale, and plays it for you). If instead of MV+1, you had pressed MV−1, the system would have moved you to the next lowest note in the scale, 'E.' If instead of MV+1 or MV−1, you had depressed MV+0, you would hear the 'F' again, even though it is not in the new key signature.

The subroutine shown in FIG. 2 contains an algorithm 18 for determining which Function Key was depressed and calculating, based on this, the octave and position (within the current scale) of the next note. For example, if we are in the key signature of 'C' and at octave 5 and position 0 (the note 'C' MIDI note #60), and we play 'MV+2', the subroutine refers to the major scale data: {0, 2, 4, 5, 7, 9, 11} to find the number two after 0, which is '4.' The calculation is then 5*12+4=64, which becomes the next MIDI note number.

Continuing with FIG. 2, if step 24 determines that the key is a sounding key, i.e, the key does not denote a scale change or a modulation, and the silent key is not currently depressed, then at step 26, the processor sends a MIDI Note-On command, followed by the MIDI "note number" and the volume specified in Set-Up mode to the MIDI port. (If there is a harmony configuration currently selected, the other harmony notes will also sound, at a slightly lower volume.) The sounding note array in memory is an array which maps each currently depressed keyboard key to a currently sounding MIDI note number or numbers (if a harmony configuration is currently selected), and this array is updated at this point. The MIDI note(s) will sound until the keyboard key mapped to it or them is released, sending a break code. (See FIG. 4) The system sends MIDI pitch bend data, normally used to produce a "sliding" effect on a synthesizer, to individually adjust every note produced from the module. The result is that this MIDI controller can play non-Western scales on any synthesizer capable of receiving pitch bend data (which is nearly all of them).

Microtonality is achieved in the present invention by means of sending MIDI "pitch bend" data. The receiving MIDI synthesizer must be set so that it has a pitch bend range of 1 semi-tone. The program sends an appropriate pitch bend value before each MIDI "note on" command is sent. The technique essentially mimics a robotic user manually pitch-bending up before each note (but much faster and more accurately than a human ever could). Since the MIDI specification allows 64 divisions of each semi-tone, the pitch value is defined as a number 12*m+p, where m represents the MIDI note value and p the upward pitch bend value, and 0<=m<=127 and 0<=p<=63, m and p are integers. This yields a number between 0 and 1,524. Note that for scales utilizing the Western equal tempered 12-tone scale, p will always be 0, since there is no need to adjust a synthesizer which has standard Western tuning.

Next, subroutine 28 in FIG. 3 shows each of the Special Function Keys and the result of striking them.

| | |
|---|---|
| $H_n$ | Harmony configuration (chord) #n |
| CLR | Midi clear, resets all buffers |
| TUNE_UP, TUNE_DN | Tune up or down by user-defined amount |
| VOL_UP, VOL_DN | Raise or lower MIDI velocity by user-defined amount |
| MONO | Enter or exit monophonic mode |
| CR_SH_UP | Chromatic shift up (right-most pedal) |
| CR_SH_DN | Chromatic shift down (left-most pedal) |
| Silent | While depressed, silences any other keys pressed |
| SER | Begin/End serial mode |
| SER_REPT | Begin/End "serial" mode in which notes can repeat |
| END | End series |

$H_n$_(30, 32)_is a chord, a set of diatonic intervals to the note you are playing. These accompanying notes sound at a volume slightly lower than the main note so as not to overpower it. As an example, the chord {−2,−4} refers to the two notes at intervals of a third below the melody (2 notes down) and a fifth below the melody (4 notes down), respectively. In other words, with this chord selected, a diatonic triad will sound with each stroke of the keyboard, with the melody line as its top note.

CLR (34, 36) is a "panic" button. It resets all internal buffers and unsticks both keyboard keys and stuck MIDI notes. It also sets all controllers to "zero" position.

TUNE-UP, TUNE-DOWN (38,40): Tuning adjustment keys:adjust tuning by amount set in setup mode.

VOL_UP, VOL_DOWN (42, 44): MIDI velocity adjustment keys: adjust MIDI velocity by amount set in setup mode.

MONO (46, 48): Toggle Monophonic mode On/Off. While on, allows only one note to sound at a time, and turns off sound to previous keypress if still sounding. While off, allows n-note polyphony, limited only by specific computer keyboard in use (usually n=16) and receiving synthesizer.

CHR_SH_UP, CHR_SH_DN: (50, 52) When a "chromatic shift" pedal or key is depressed, the subsequent note(s) you are playing will be lowered or raised by one chromatic step until the pedal or key is released. In a way, these have the same effect as pressing (and releasing) T1 to shift up and then T11 to return to the original key signature (or T11 to shift down and T1 to return), except in two respects: first, when using a chromatic shift there is only one pedal or key depression (and release) necessary, and second, the chromatic shift is something that happens after all other calculations are made, something akin to the chromatic pitch shift of a harmonica.

"Silent" (54,56) silences any move(s) played while this key or pedal is depressed. This is to say, the move(s) are made, but no sound is heard. This is necessary because with the preferred keyboard assignment, to play an interval of over 7 notes (except 14) one must use a combination of two keys, usually MV+7 plus MV+n, where 1<=n<=6. (Or to descend, MV−7 plus MV−n.) Note that because pressing two (or even more) keys to make one move might be too slow for use in a rapid passage, this feature is probably more useful assigned to a pedal. If you wish to play music with a lot of large jumps, you might consider a more appropriately assigned keyboard layout.

PITCH TRANSPOSER (58,60): When on, sends MIDI Continuous Controller Data on particular channel and controller # as specified in setup mode. This feature allows user to provide a monotone audio source such as a voice drone or a mouthpiece of a wind instrument and manipulate its pitch by striking keys on the keyboard. Further interesting results may result from changing the pitch value of the audio source as well as striking the keys on the keyboard. Of course, the user may then elect to hear only the resultant pitch-transposed audio signal, or mix this with audio from a synthesizer receiving MIDI note-on/off signals from the unit.

When this feature is enabled, for each note to be played, the program sends a corresponding controller command, using any user-defined controller (currently #12 is in use), and such that the controller data range 0–127 corresponds to the usable range of values for the transposer unit. E.g, if one uses a unit with a two-octave transposition range (one down and one up from incoming signal), which is it say a range of 25 notes. Thus the formula, pitch_transposition=(midi_value_64)*127/25.

(Above the value 64 represents the MIDI midpoint, so that when the system sends a midpoint MIDI note value, the pitch transposer unit will not change the pitch.) This formula can be hard-coded into the unit, or customized by the user in order to accommodate any MIDI pitch transposer.

SER, SER_REPT and END (62, 64) all relate to the serial mode in which a tone row is first created from notes as they are played, and then played back in any order.

SER begins the "recording" of the tone row. After this is depressed, each subsequent pitch is recorded. If a pitch would have duplicated one already in the tone row, the next available pitch (higher if the move is ascending or lower if descending) is selected. When you wish to end recording, press END. If END is not depressed before the number of notes in the underlying scale is reached, the recording is automatically ended. Once the recording of the tone row is complete, the player can then cycle through it forwards, backwards or in any order (skipping by two's, etc.) he or she chooses. The tone row acts exactly as a new scale, except that it is cyclical. To end serial mode, depress SER once more.

SER_REPT: serial mode in which notes CAN be repeated and cycle re-starts only when SER_END is pressed.

There are also a number of other functions which may be included in a user's preferred keyboard assignment but cannot be included all at one time because of the limited number of keys on a keyboard. These include a free pitch key with which pitch is determined relatively but without a pre-determined scale. For example, the key might halve the difference (logarithmically) between the current pitch and the next root up, so that iterations of this keypress would move you closer to that root but never reach.

Other keys may select real-time effects, repetition with real-time delay or an actual delay when a keypress plays current note as well as the one from n keypresses ago.

One key may initiate quantization of playing wherein the timing of notes is corrected.

Another key may provide for a pattern to be recorded as in serial feature, but to continue in real-time or triggered by each subsequent keypress, while user continues playing in normal mode.

FIG. 4 shows the subroutine 66 performed when a break code is received by the processor. If the code represents the release of a chromatic shift key (CHR_SH_UP or CHR_SH_DN) (step 68), then the chromatic shift parameter is set to zero at step 70, i.e., future notes will sound in the key signature selected, and not a chromatic step up or down.

If the code represents the release of the silent key (step 72), then the unit is restored to normal sounding operation (step 74). I.e., future keystrokes will sound if appropriate.

If the code represents the release of a currently sounding key (step 76), then a MIDI "Note Off" sequence is sent to the MIDI port (step 78) for the MIDI note number(s) associated with that key (found in the sounding note array). The Sounding Note array is updated accordingly.

If the break code represents none of these keys, it is ignored.

Figure 5:
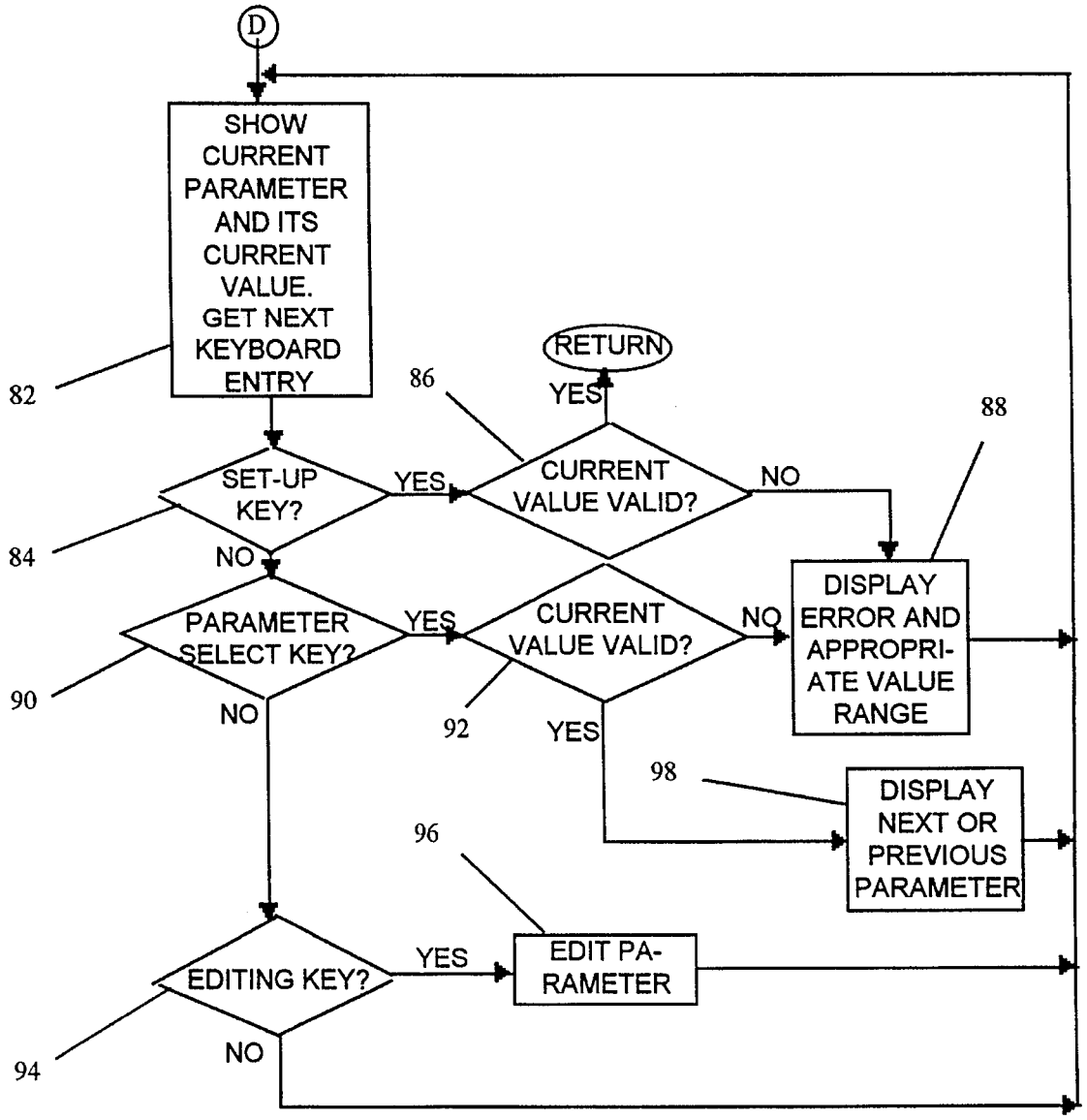
FIG. 5 is a flowchart of the subroutine performed when a regular function key is selected by the operator in an electronic musical instrument according to one embodiment of the invention.

FIG. 5 shows the subroutine for the Setup Mode, in which following parameters affecting operation of the unit may be modified:

- Scale data (Scale name, # of notes, chromatic step, interval values)
- Harmony Configuration data (interval values)
- Keyboard Assignment data (which key is assigned to which Function code)
- Patch selection data (which key selects which patch #)
- MIDI In/Out Channel
- Multi-Channel Mode data (which channels m–n to cycle through, and whether mode is on. For use with multi-timbral or multiple synthesizers—keeps microtonal chords in tune, since each channel has separate pitch-bend setting)
- MIDI Sound: Whether to produce sound via MIDI
- Micro Sound: Whether to produce sound generated by microprocessor.
- PC Sound: Whether to produce sound through PC's internal speaker (software version only)
- Display: What to display. (See DISPLAY MODES below.)
- Pitch Transposer: Whether to transmit MIDI data to control pitch transposer and which MIDI channel and continuous controller # to use.
- Legato Play in which keys sound on "make" until a "Stop Sound" key is pressed
- Define 'n' for P_UN. (See description of Function Keys)
- Filtering of audio, etc., in real-time, either using:
  - direct manipulation of built-in synthesizer,
  - System Exclusive data (which would require advance knowledge of each specific synthesizer manufacturer's MIDI implementation or the ability to program it in to this unit).
- Bank data (Convenient storage of all above settings)

No matter which parameter is to be modified, the process is the same. First the current parameter (#0 to start) is displayed on the display screen, along with its current value. Then the make code is read by the processor (82). If it is the Setup Key (84), it is determined whether the currently showing value is appropriate for the currently showing parameter (86), and if it is, the user is returned to Play Mode. Otherwise (88), the display shows an error message indicating the appropriate range of values for this parameter, and the processor returns to waiting for the next keyboard entry (82).

If the key is a parameter select key (an up/down arrow or PgUp/PgDn), then if the currently showing value is appropriate for the currently showing parameter (92) the display shows the next (if a "down" key) or previous (if "up") parameter with its current value (98). If the value is not appropriate, the display shows an error message indicating the appropriate range of values for this parameter (88), and the processor returns to waiting for the next keyboard entry (82).

If the key is an editing key (+,–, del, ins, backspace, number keys) (94), then the current value is appropriately edited (96) and the system returns to waiting for the next keyboard entry (82).

DISPLAY MODES

Display current octave and position, current scale, current key signature (standard letters with sharps and flats for Western scales, numerical values for non-Western scales) The following graphical modes require a graphic display:

- Graphical display of current pitch over time (scrolls left). Have different modes:
  - Standard Western score, in which user sees current pitch in bass or treble clef, and plus or minus signs on keys which are microtonally in between equal-tempered pitches.
  - Special microtonal score, dependent on particular scale
  - Special score, in which codes are plotted such that a MV+0 is plotted on the middle line of standard 5-line staff, and MV+1 is the space above middle line, MV–1 is the space below middle line, MV+2 is the line above the middle line, etc. A move up by a third, chromatically shifted downward would be represented a flatted note in the second space above the middle line. This system is currently in use to transcribe music for the instrument.
- Graphical display of the computer keyboard, showing which keys are currently depressed While preferred embodiments have been discussed above, various modifications and variations may be made thereof within the inventive concept and other embodiments are included in the invention which may not be illustrated in the drawings or described above.

For example, the invention may be implemented in a software version for stand alone personal computers having an installed MIDI card (MPU-401 or MV-101 compatible). In such an embodiment, the software may produce a MIDI output signal for use with external synthesizer(s) or tones using an internal speaker of the personal computer.

Of course, the invention may also be implemented in software designed for personal computers without a MIDI card to produce tones using an internal speaker of personal computer or other means. Such an embodiment may include a sound card so that no additional synthesizer is needed.

The invention may be implemented as circuitry physically mounted onto an IBM-compatible keyboard or a keyboard specially designed for this purpose, with a synthesizer or sound card built in, so that it becomes a stand-alone, sound-producing unit (with optional MIDI out). Such a unit would be very compact and light.

The invention may also be included as a selectable feature in otherwise conventional keyboards or synthesizers having piano-style keyboards. Such a unit would be familiar to keyboardists. A separate keyboard may be provided on the unit in addition to the piano-style keyboard.

The invention could utilize a "fretless" or zoned keyboard, enabling quasi-analog assignment of move values: movement left or right or up or down on position-sensitive pad could cause corresponding variations in move value sent. (E.g., a keypress slightly left of center on the MV+2 key might change the pitch by slightly less than two notes up in the scale, and a keypress slightly right of center would yield a pitch slightly more than two notes up in the scale.) In this system the user could generate vibrato by oscillating the finger rapidly.

What is claimed is:

1. An electronic musical instrument comprising:

an input device, responsive to the selection of keys by an operator, generating electronic signals respectively indicating the selection of keys on said input device;

an input/output control circuit, connected to the input device, for receiving the electronic signals generated by said input device respectively indicating the selection of keys on said input device;

a memory containing program instructions for converting said electronic signals generated by said input device into signals respectively indicating sounds to be reproduced;

a microprocessor-based processing circuit, connected to the input/output control circuit, for processing the electronic signals generated by said input device according to the program instructions contained in said memory so that the electronic signals generated by said input device control interval changes in pitch and generating output signals obtained as a result of said processing; and an output circuit for converting said output signals from said microprocessor-based processing circuit into signals respectively indicating the sounds to be produced by said electronic musical instrument.

2. An electronic musical instrument as claimed in claim 1, wherein the electronic signals generated by said input device indicate diatonic interval changes in pitch value.

3. An electronic musical instrument as claimed in claim 2, wherein said processing circuit converts said electronic signals into musical tones by adjusting the previous electronic signal according to the interval change indicated by the present electronic signal.

4. An electronic musical instrument as claimed in claim 1, wherein the input device comprises a typewriter style keyboard.

5. An electronic musical instrument as claimed in claim 4, wherein each of the keys of the keyboard has a function assigned to it by a user.

6. An electronic musical instrument as claimed in claim 1, wherein relative key signature changes and changes of the base scale are accomplished with the touch of a button or foot pedal.

7. An electronic musical instrument as claimed in claim 2, wherein the diatonic interval changes comprise changes in non-western musical scales.

8. An electronic musical instrument as claimed in claim 1, wherein said instrument is MIDI compatible, and further comprises a MIDI card which accepts MIDI input signals and outputs both MIDI output signals and audio output signals and a passive backplane, connecting said MIDI card and said processing circuit, for transferring data between said MIDI card and said processing circuit.

9. An electronic musical instrument as claimed in claim 1, wherein said input device comprises a set up key, special function keys, and regular function keys.

10. An electronic musical instrument according to claim 1, wherein said input device comprises a fretless keyboard which provides quasi-analog assignment of move values.

11. An electronic musical instrument according to claim 9, wherein said processing circuit displays a current parameter and it current value in response to the selection of the set-up key of the input device.

12. An electronic musical instrument as recited in claim 3, wherein the key signature or base scale may be changed to a new key signature or new base scale at any time and wherein, when the key signature or base scale is changed to a new key signature or new base scale, the value of the next output signal generated by said microprocessor-based processing circuit is obtained as a result of processing the previous electronic signal according to an interval change in pitch value corresponding to said new key signature or new base scale.

13. An electronic musical instrument as recited in claim 2, wherein the key signature or base scale may be changed to any one of a number of different key signatures or base scales at any time and each one of said electronic signals indicating the selection of a respectively corresponding key on said input device generated by said input device indicates the same respective diatonic interval change in pitch value in each one of said different key signatures or base scales.

14. A method for electronically producing music comprising the steps of:

generating electronic signals by selecting keys on an input device;

receiving the electronic signals generated by selecting keys on said input device in an input/output control circuit;

providing program instructions for converting said electronic signals generated by selecting keys on said input device into signals respectively indicating sounds to be reproduced;

processing the electronic signals generated by selecting keys on said input device according to the program instructions so that the electronic signals generated by said input device controls interval changes in pitch;

generating output signals obtained as a result of said processing; and converting said output signals into signals respectively indicating the sounds to be produced.

15. A method for electronically producing music as claimed in claim 14, wherein the electronic signals generated by selecting keys on said input device indicate diatonic interval changes in pitch value.

16. A method for electronically producing music as claimed in claim 15, wherein said step of converting comprises converting said electronic signals into musical tones by adjusting the previous electronic signal according to the interval change indicated by the present electronic signal.

17. A method for electronically producing music as claimed in claim 14, further comprising the step of assigning a function to each of the keys on the input device.

18. A method for electronically producing music as claimed in claim 14, further comprising the step of touching a button or foot pedal to make relative key signature changes and changes of the base scale.

19. A method for electronically producing music as claimed in claim 14, further comprising the step of displaying a current parameter and its current value in response to the selection of the set-up key of the input device.

20. A tangible medium storing instructions for implementing a process, the instructions instructing an apparatus to generate sounds in accordance with the selection of keys by a user, said tangible medium storing instructions instructing the apparatus to implement the steps of:

receiving electronic input signals from an input device having a plurality of keys, each one of said electronic input signals indicating the selection of one of said plurality of keys on said input device and identifying the respective selected key;

processing each one of said electronic input signals from said input device to obtain respectively corresponding output signals, each one of said output signals representing a musical note which is obtained by adjusting the pitch value of a musical note represented by the previous one of said output signals according to a diatonic interval change in pitch value attributed to the selected key identified by the respectively corresponding one of said electronic input signals; and outputting said output signals to a device for generating musical notes.

* * * * *